United States Patent [19]

Champagne

[11] Patent Number: 4,947,609

[45] Date of Patent: Aug. 14, 1990

[54] TOP OUT PANEL MOUNTING CLIP FOR VINYL SIDING

[76] Inventor: Charles A. Champagne, 6731 Desert Rose La., Houston, Tex. 77087

[21] Appl. No.: 377,483

[22] Filed: Jul. 10, 1989

[51] Int. Cl.[5] ..... E04D 1/34

[52] U.S. Cl. ..... 52/545; 52/547; 52/543; 52/520; 52/478

[58] Field of Search ..... 52/543, 545, 542, 544, 52/547, 520, 528, 478, 489, 506

[56] References Cited

U.S. PATENT DOCUMENTS 2,511,083 6/1950 Small ..... 52/547

FOREIGN PATENT DOCUMENTS 10328 5/1898 United Kingdom ..... 52/547

*Primary Examiner*—David A. Scherbel
*Assistant Examiner*—Creighton Smith
*Attorney, Agent, or Firm*—Russell J. Egan

[57] ABSTRACT

A clip for installing the top out panel of vinyl siding is formed from a continuous strip of metal having seven contiguous portions defining two vertically spaced gripping channels adapted to engage the overlying top edge of a last panel and bottom edge of a top out panel, respectively. The clips allow for easy installation, float of the top out panel, and a finished surface free from nails.

10 Claims, 1 Drawing Sheet

TOP OUT PANEL MOUNTING CLIP FOR VINYL SIDING

BACKGROUND OF THE INVENTION

1. The Field of the Invention

The present invention relates to a top out clip for the vinyl siding industry and in particular to a clip for securing the top panel on a wall beneath the soffit without maring the surface of any of the mating panels and while allowing the necessary float.

2. The Prior Art

There has been a continuing preference for the use of vinyl siding in the building industry because of the low wear and maintainance characteristics of this material. Vinyl panels are generally extruded or formed into panels 12 feet long and 8 or 10 inches wide, each panel being profiled to simulate one or more rows of the traditional lapped wooden siding. The panels are made with a perminent coloring and with a variety to textured surface finishes.

This siding is usually installed with the panels in overlapping and/or interlocking rows starting from the bottom of the wall. A specially formed panel is used at the top of the wall engaging both the last row and the siffit panel. This is where there has been a problem in that the vinyl panels cannot have nails driven through their faces, as this would clearly mar the finished appearance while preventing float of the panel necessary to accommodate for expansion and contraction due to ambient temperature conditions.

SUMMARY OF THE INVENTION

The present invention has as an object to make it easier to install vinyl top panels without the need for face nailing thereby making the installer's job easier, faster and more versitile. The subject clip also allows the panel to expand and contract freely.

The subject top out clip is a continuous metal member formed from a blank approximately one inch wide and three and one quater inches long. The metal blank is formed into seven portions defining two downwardly opening gripping channels, intermediate profiling, and a terminal shelf. The subject clip is at least partially formed with the final forming being accomplished by the installer to speed assembly of the clip on the panel.

BRIEF DESCRIPTION OF THE DRAWINGS

The present invention will be described by way of example with reference to the accompanying drawings in which.

DETAILED DESCRIPTION OF THE PREFERRED EMBODIMENT

Figure 1:
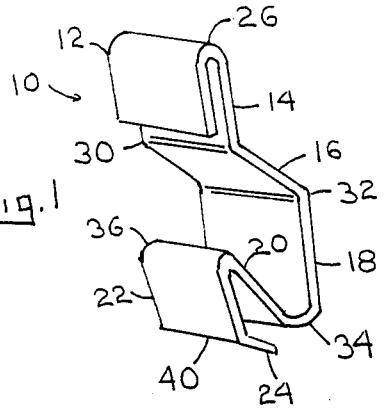
FIG. 1 is a perspective view of the subject top out clip.
Figure 2:
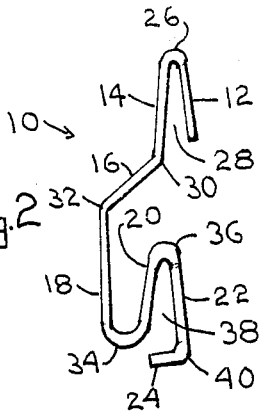
FIG. 2 is a side elevation of the subject clip.

The subject top out clip 10 is preferably formed from strip aluminum stock about 0.022 to 0.024 thick, about one inch wide and approximately three and one quarter inches long. It is a continuous unitary member having first through seventh portions 12, 14, 16, 18, 20, 22, and 24. First portion 12 is approximately ⅝" long and meets the second portion 14 along bight 26 at an angle of approximately 70–80. The second portion 14 is also approximately ⅝" long. The first and second portions together define a first downwardly opening gripping channel 28. The third portion 16 is about 5/16; " long and extends along bight 30 from the second portion at approximately a 70 angle. The fourth portion 18 is approximately ⅝" long and extends from the third portion 16 along bight 32 to lie approximately parallel to the second portion 14. The fourth and fifth portions 18,20 are connected together along roll formed bight 34 and lie at an angle of approximately 170 to each other with the fifth portion behind the fourth portion. The sixth portion 22 is also approximately ½ long and is attached to the fifth portion 20 by a roll formed bight 36 forming an angle of about 170 to form a second downwardly opening gripping channel 38. The gripping channels 36, 38 are vertically spaced and both open in the same direction, downward in mormal installation. The seventh portion 24 is approximately 3/16" wide and extends from the sixth portion along bight 40 at approximately 80 to form a lip or shelf at the lower end of the second gripping channel 38.

Figure 3:
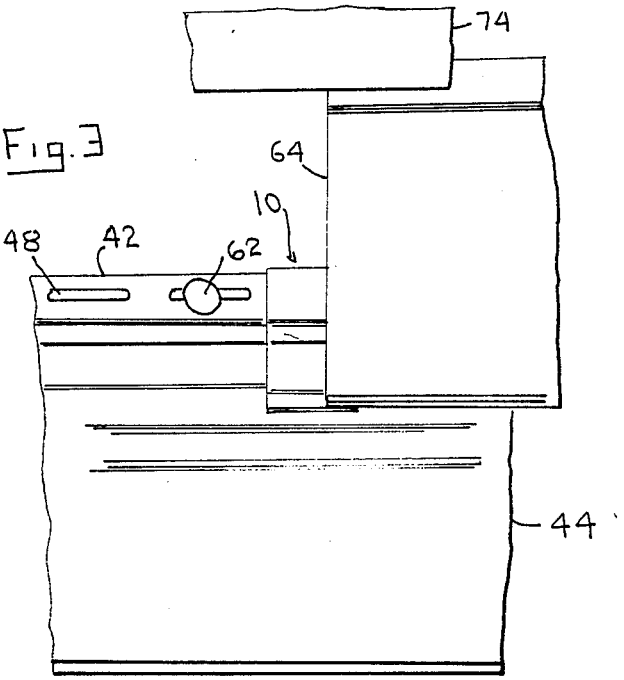
FIG. 3 is a front elevation showing the subject clip as it would be used to mount a top panel on a typical wall.
Figure 4:
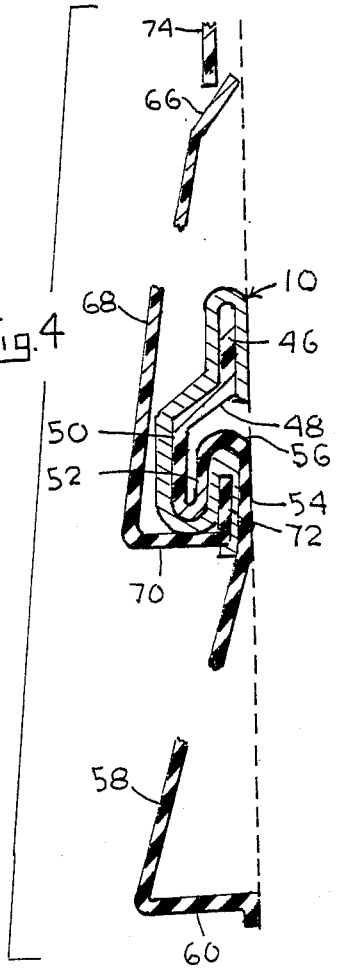
FIG. 4 is a section, on larger scale, showing the subject clip sercuing a top panel in place.

The subject clip is mounted on the upper edge 42 of the next to top panel 44, as shown in FIGS. 3 and 4. The upper edge of the panel is formed with a nailing lip 46 having holes 48 spaced therealong, adjacent portions 48,50,52, and 54 forming a gripping lip 54 and channel 56. The panel 44 is completed by a face 58 and footer portion 60.

The clips 10 are mounted on the upper edge of the panel spaced apart about 18". The fifth and sixth portions of the clip are received in the channel 56 while the second, third and fourth portions overlie the portions 48,50, 52, respectively. The first portion 12 need not be fully formed so that the installer's job is somewhat easier. After the second through sixth portions are properly positioned, as described above, the first portion can be bent over the panel edge 42 to complete installation of the clip. The panel 44, with clips 10 in place, is nailed to the wall with conventional nails 62.

The top out panel 64 is a specially formed vinyl panel having a top lip 66, a face 68, a foot 70 and a locking lip 72. This panel may be somewhat narrower than panel 44 and would be trimmed to size to fit the opening to be covered. The soffit 74 is of any one of the known configurations.

The lip 66 of the top out panel would be inserted under the soffit panel and the lip 72 inserted into the bottom channel flange 38 with the foot lying on shelf portion 24. It will be appreciated that this installation allows the top out panel to be free of face nails, to be capable of movement necessary to prevent buckling due to temperature, and to be readily accomplished by the installer.

The present invention may be subject to many changes and modifications without departing from the spirit or essential characteristic of the present invention.

I claim:

1. A clip for installing building siding top out panels between an upper most siding panel and a soffit, said clip comprising:

a strip of metal material having seven contiguous portions defining two vertically spaced and downwardly opening channels and an intermediate portion conforming to a profile of an upper most siding panel, said channels respectively gripping an overlying upper edge portion of said upper most siding panel and a bottom edge portion of a top out panel whereby said top out panel is secured in place without face nailing.

2. A clip for nailless installation of a top out panel of siding material on the upper edge of the upper most panel on a building, said clip comprising:

a continuous strip of metal formed to define a downwardly directed lower panel gripping first channel and a downwardly directed top out panel gripping second channel and an intermediate portion profiled to conform to the surface of said upper most panel.

3. A clip according to claim 2 wherein said first channel is disposed above said second channel whereby said upper and lower panels will be installed in an overlapping condition.

4. A clip according to claim 2 wherein said first channel is formed on site to facilitate instalation of said clip.

5. A clip according to claim 2 wherein said metal is 0.022 to 0.024 thick aluminum and is of sufficient rigidity to hold its formed shape.

6. A clip according to claim 2 wherein said strip defines first through seventh contigious portions joined together by respective bights, first and second portions formed in overlying fashion to define said first channel, third and fourth portions conforming to the profile of said siding panel, fifth and sixth portions formed in overlying fashion behind said fourth portion to define said second channel, and said seventh portion forming a shelf beneath said second channel to receive and support said top out panel.

7. In an installation on a building of siding panels covering wall surfaces of said building, soffit covering panels, and top out panels mounted between the upper most siding panel and the soffit, a clip for nailless mounting of said top out panel, said clip comprising:

a strip of metal having a plurality of contiguous portions forming a downwardly directed upper gripping channel adapted to grip an upper edge of said upper most siding panel, a downwardly directed lower gripping panel adapted to grip the lower edge of said top out panel, and an intermediate section joining said channels and formed to conform to the profile of said siding panel.

8. A clip according to claim 7 wherein a plurality of said clips are spaced along said siding panel approximately eighteen inches apart.

9. A clip according to claim 7 wherein said clip is formed from aluminum mill finish stock 0.022 to 0.024 thick, approximately ½" wide and approximately 3¼" 1/4 long.

10. A clip according to claim 7 wherein said siding panel and said top out panel are made of vinyl, said lower gripping channel being received in an interlocking fold of said siding panel to recveive said top out panel therein.

* * * * *